US010811773B2

(12) United States Patent
McGough et al.

(10) Patent No.: US 10,811,773 B2
(45) Date of Patent: Oct. 20, 2020

(54) BROADBAND KANDOIAN LOOP ANTENNA

(71) Applicant: PC-TEL, Inc., Bloomingdale, IL (US)

(72) Inventors: Erin McGough, Cuyahoga Falls, OH (US); Thomas Lutman, Berlin Center, OH (US)

(73) Assignee: PC-TEL, INC., Bloomingdale, IL (US)

( * ) Notice: Subject to any disclaimer, the term of this patent is extended or adjusted under 35 U.S.C. 154(b) by 196 days.

(21) Appl. No.: 15/944,950

(22) Filed: Apr. 4, 2018

(65) Prior Publication Data

US 2019/0103675 A1 Apr. 4, 2019

Related U.S. Application Data

(60) Provisional application No. 62/565,896, filed on Sep. 29, 2017.

(51) Int. Cl.
*H01Q 7/00* (2006.01)
*H01Q 21/20* (2006.01)
(Continued)

(52) U.S. Cl.
CPC ..... *H01Q 7/00* (2013.01); *H01Q 9/04* (2013.01); *H01Q 21/205* (2013.01); *H01Q 1/38* (2013.01); *H01Q 21/26* (2013.01)

(58) Field of Classification Search
CPC ..... H01Q 21/205; H01Q 21/26; H01Q 9/04; H01Q 1/38; H01Q 5/50
See application file for complete search history.

(56) References Cited

U.S. PATENT DOCUMENTS 2,490,815 A 12/1949 Kandoian
6,400,332 B1 * 6/2002 Tsai ..... H01Q 9/285 343/700 MS
(Continued)

FOREIGN PATENT DOCUMENTS

JP 11-261335 A 9/1999
JP 2009-231927 A 10/2009
JP 2012-15748 A 1/2012

OTHER PUBLICATIONS

Examination report for corresponding EP patent application 18196995.7, dated Nov. 25, 2019.
(Continued)

*Primary Examiner* — Awat M Salih
(74) *Attorney, Agent, or Firm* — Husch Blackwell LLP

(57) ABSTRACT

A wideband Kandoian loop antenna is provided. The impedance bandwidth of the antenna can be enhanced relative to antennas known in the art by capacitively coupling to radiating sections on the antenna, thereby ensuring efficient operation of the antenna over a wide frequency band. The antenna can include a highly symmetric arrangement that can yield a circular current distribution that resembles that of a small loop antenna driven by a constant current source. The circular current distribution can beget excellent radiation patterns, for example, when the antenna is integrated in a ceiling-mounted access point, and the circular current can radiate a strongly horizontally polarized electric field that decouples the antenna from nearby vertically polarized antenna elements, thereby allowing the antenna to be collocated with vertically polarized elements with little degradation to overall system level performance.

7 Claims, 7 Drawing Sheets

(51) Int. Cl.

| | |
|---|---|
| ***H01Q 9/04*** | (2006.01) |
| *H01Q 21/26* | (2006.01) |
| *H01Q 1/38* | (2006.01) |

(56) References Cited

U.S. PATENT DOCUMENTS

| | | | | |
|---|---|---|---|---|
| 2007/0069968 | A1 * | 3/2007 | Moller ..... | H01Q 9/285<br>343/795 |
| 2017/0025764 | A1 | 1/2017 | McGough et al. | |

OTHER PUBLICATIONS

Extended European search report for corresponding EP patent application 18196995.7, dated Feb. 4, 2019.
English-language Abstract for JP patent publication 11-261335, dated Sep. 24, 1999.
English-language translation for JP patent publication 2009-23192, dated Oct. 8, 2009.
English-language translation for JP patent publication 2012-15748, dated Jan. 19, 2012.

* cited by examiner

BROADBAND KANDOIAN LOOP ANTENNA

CROSS-REFERENCE TO RELATED APPLICATIONS

This application claims priority to U.S. Provisional Patent Application No. 62/565,896 filed Sep. 29, 2017 and titled "BROADBAND KANDOIAN LOOP ANTENNA." U.S. Provisional Patent Application No. 62/565,896 is hereby incorporated herein by reference.

FIELD

The present invention relates generally to radio frequency (RF) communication hardware. More particularly, the present invention relates to a broadband Kandoian loop antenna.

BACKGROUND

An ever increasing demand for greater bit capacity solutions drives the need to collocate a greater number of antennas within a single product housing or limited geographic area. As the number of collocated antennas increase, the number of possibilities by which the antennas may be mapped to one or more RF transceivers increase. Several architectures are known. First, all of the collocated antennas may be connected to a single radio. Second, the collocated antennas may be divided between multiple radios operating in the same spectrum. Third, the collocated antennas may be divided between multiple radios operating in different frequency bands that are relatively close in frequency. Fourth, the collocated antennas may be divided between multiple radios operating in different frequency bands that are far apart.

Some amount of antenna isolation (approximately 25 dB) is desired for each of the different architectures. However, each of the different architectures may have different requirements for antenna isolation to ensure desired system level performance, depending on how the collocated antennas are mapped to the transceiver(s). For example, the architecture that includes the collocated antennas divided between the multiple radios operating in the same spectrum requires the greatest antenna isolation between the collocated antennas connected to different radios because the different radios will otherwise inevitably interfere with one another.

The most spatially effective and energy efficient way to achieve antenna isolation is to cross-polarize sets of antennas mapped to the different radios. One of the sets can be designed to radiate and receive vertically polarized radiation, and another of the sets can be designed to radiate and receive horizontally polarized radiation. In this regard, a Kandoian loop antenna, such as the antenna disclosed in U.S. Pat. No. 2,490,815, is known to have a highly omnidirectional radiation pattern in the azimuth plane that is strongly horizontally polarized. A graph illustrating input impedance versus frequency for one such Kandoian loop antenna known in the art is shown in FIG. 1. Known Kandoian loop antennas can be matched well at a single frequency (e.g. 5.5 GHz), but the resulting match will suffer from a narrow bandwidth, and system efficiency and/or stability may be compromised at certain in-band frequencies.

In view of the above, there is a continuing, ongoing need for improved antennas.

DETAILED DESCRIPTION

Figure 1:
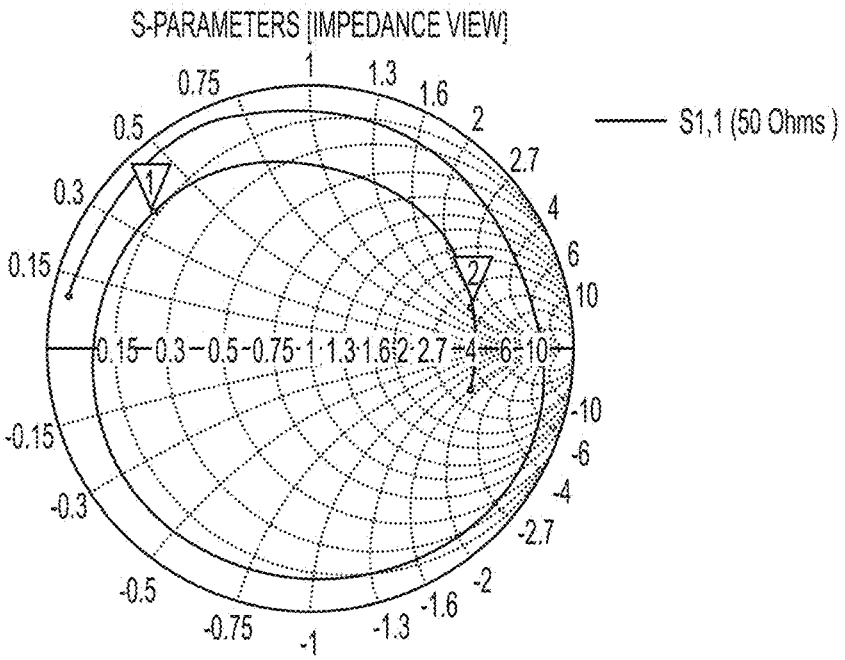
FIG. 1 PRIOR ART
FIG. 1 is a graph illustrating input impedance versus frequency for a Kandoian loop antenna known in the art.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include a broadband Kandoian loop antenna that can extend the operating bandwidth of a Kandoian loop antenna known in the art to a range suitable for operating over the entirety of a high frequency wireless band (e.g. the 5 GHz band of 5150 MHz to 5875 MHz) without any degradation. For example, in some embodiments, the broadband Kandoian loop antenna disclosed herein can be tuned to operate over a broad percent bandwidth of greater than 20 percent with a voltage standing wave ratio of 2:1 and with little change to the far field radiation patterns. Although not limiting, it is to be understood that systems and methods disclosed herein can be used in conjunction with an architecture that includes collocated antennas that are divided into sets mapped to multiple, unique radios operating in different frequency bands that are relatively close in frequency. For example, in some embodiments, the broadband Kandoian loop antenna disclosed herein may be a strongly horizontally polarized antenna element that can be used in a system that includes both vertically and horizontally polarized antenna elements, such as a Wi-Fi access point that requires low profile, strongly polarized, omnidirectional antenna elements.

Although not limiting, it is also to be understood that systems and methods disclosed herein can be integrated into a ceiling mounted Wi-Fi access point operating over a high frequency wireless band, such as the 5 GHz band, and that the strongly horizontally polarized omnidirectional antenna can be well isolated (e.g. greater than 40 dB) from strongly vertically polarized antennas, such as the antenna disclosed in U.S. Provisional Patent Application No. 62/669,990, over an operating frequency band at a distance of at least 50 mm or 2 inches. For example, in some embodiments, the broadband Kandoian loop antenna disclosed herein can radiate a high degree of horizontal polarization in the azimuth plane and have radiation patterns suitable for an embedded antenna deployed in the ceiling mounted Wi-Fi access point.

In accordance with disclosed embodiments, radiating sections of the broadband Kandoian loop antenna disclosed herein can be capacitively coupled, for example, using some of the systems and methods for capacitive coupling disclosed in U.S. application Ser. No. 14/807,648 (published as U.S. Publication No. 2017/0025764). In some embodiments, antenna elements printed on a top side of a substrate can be capacitively coupled to radiating sections printed on a bottom side of the substrate.

Figure 3A:
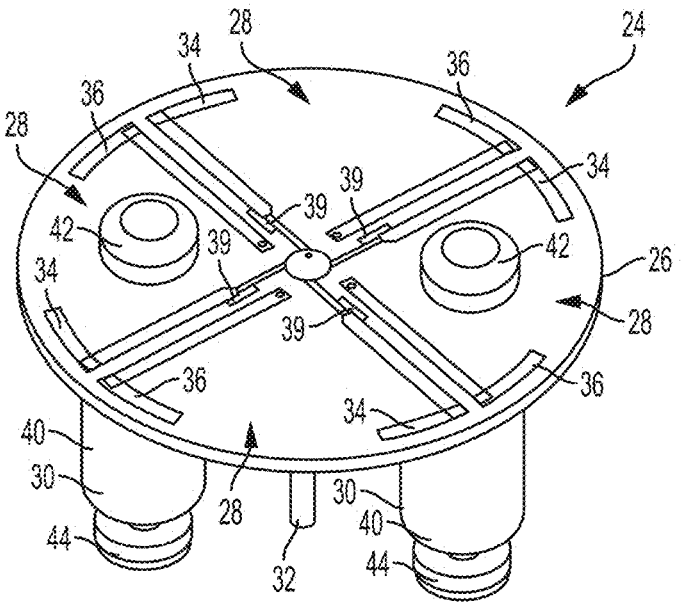
FIG. 3A is a top perspective view of a broadband Kandoian loop antenna in accordance with disclosed embodiments.
Figure 3B:
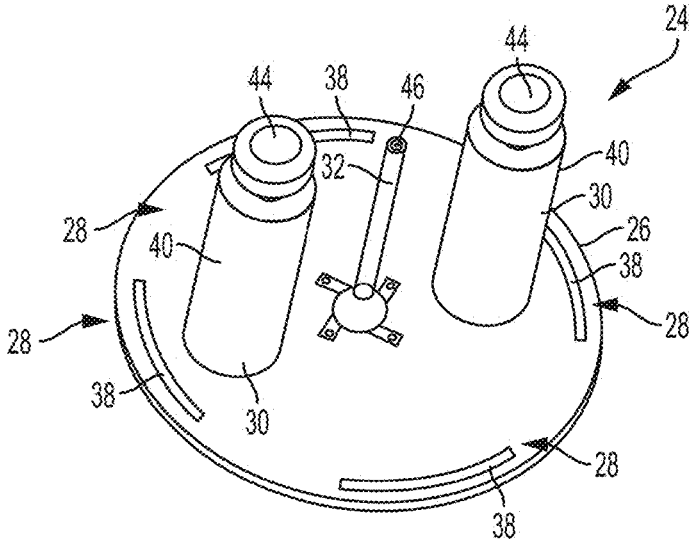
FIG. 3B is a bottom perspective view of a broadband Kandoian loop antenna in accordance with disclosed embodiments.

FIG. 3A is a top perspective view of a broadband Kandoian loop antenna 24 in accordance with disclosed embodiments, and FIG. 3B is a bottom perspective view of the broadband Kandoian loop antenna 24. The antenna 24 may include a printed circuit board 26, a plurality of loop segments 28, fastening elements 30, and a coaxial cable 32. In some embodiments, the antenna 24 may be realized by copper strips printed on a substrate of the printed circuit board 26, and in some embodiments, the substrate may be a 0.028 inch thick FR4 substrate manufactured using standard printed circuit board fabrication technology known in the art.

Figure 6:
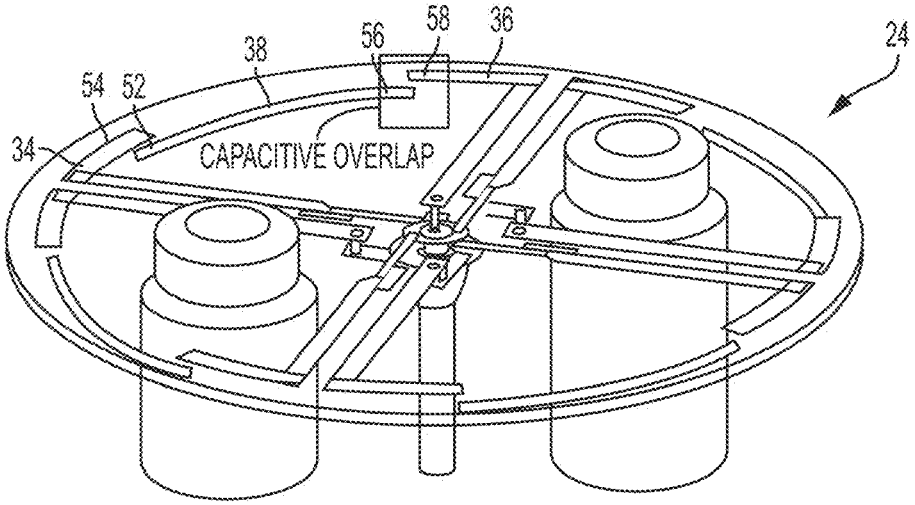
FIG. 6 is a semi-transparent perspective view of a broadband Kandoian loop antenna and overlapping copper strips thereof in accordance with disclosed embodiments.

In some embodiments, each of the plurality of loop segments 28 may include a respective transmission section 34 electrically coupled to an input feed of the coaxial cable 32, a respective return section 36 electrically coupled to a respective short circuit point coupled to an exterior or return portion of the coaxial cable 32, and a respective radiating section 38 capacitvely coupled between the respective transmission section 34 and the respective return section 36. In some embodiments, each of the plurality of loop segments 28 may be printed on the substrate of the printed circuit board 26. For example, as seen in FIG. 6, the respective radiating section 38 of each of the plurality of loop segments 28 may be printed on a first plane of the substrate, such as a bottom of the substrate, and the respective transmission section 34 and the respective return section 36 of each of the plurality of loop segments 28 may be printed on a second plane of the substrate that is parallel to the first plane, such as a top of the substrate. In some embodiments, each of the plurality of loop segments 28 may be evenly distributed around a center of the printed circuit board 28, and in some embodiments, the respective transmission section 34 of each of the plurality of loop segments 28 can include a respective distributed impedance matching portion 39.

In some embodiments, the fastening elements 30 can be used to secure the antenna 24 within a product or a housing. For example, as seen in FIG. 3A and FIG. 3B, the fastening elements 30 can include non-conductive spacers 40, non-conductive fasteners 42, and generic fasteners 44 to secure the antenna 24 within the product or the housing. In some embodiments, the non-conductive spacers 40 may include threaded nylon spacers, the non-conductive fasteners 42 may include nylon screws, and the generic fasteners 44 may include stainless steel screws.

For example, in some embodiments, the non-conductive spacers 40 may separate the printed circuit board 26 from a ground plane, the non-conductive fasteners 42 can secure the printed circuit board 26 to the non-conductive spacers 40 from the top of the printed circuit board 26, and the non-conductive spacers 40 may be fastened to the ground plane using the generic fasteners 44. In some embodiments, the printed circuit board 26 may be mounted on and spaced off the ground plane at a plurality of different heights, and in some embodiments, the printed circuit board 26 may be mounted directly to a radome using a snap-in procedure or heat-stake operation.

The coaxial cable 32 can connect the antenna 24 to a radio on a radio board below the ground plane, and as seen in FIG. 3A and FIG. 3B, the coaxial cable 32 may include a center conductor 46 and an exterior shield. In some embodiments, the coaxial cable 32 may be a 1.32 mm or 1.37 mm coaxial cable terminated in an RF connector such that the center conductor 46 can be soldered to the top side of the printed circuit board 26 and the exterior shield can be soldered to the bottom side of the printed circuit board 26.

Figure 4:
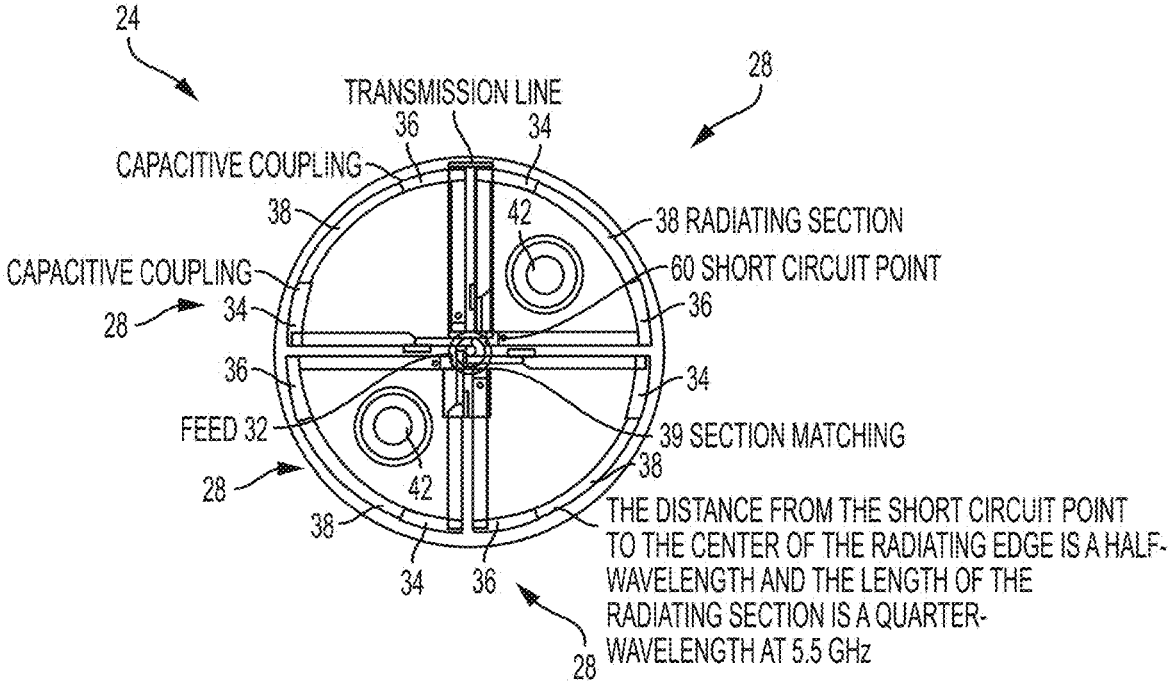
FIG. 4 is a plan view of a broadband Kandoian loop antenna in accordance with disclosed embodiments.

FIG. 4 is a plan view of the antenna 24. When in a transmitting mode, the coaxial cable 32 can be excited by a wide band RF signal at a carrier frequency between 5 GHz and 6 GHz, and power from the coaxial cable 32 can be divided into each of the plurality of loop segments 28 disclosed herein. In some embodiments, the antenna 24 can include four loop segments 28. As seen in FIG. 4, each of the plurality of loop segments 28 can include the respective short circuit point 60. In this regard, a radiation condition can be enforced by (1) setting the distance between the respective short circuit point 60 and the center of the respective radiating section 38 of each of the plurality of loop segments 28 to be approximately half of a 5.5 GHz signal wavelength and (2) setting the length of the respective radiating section 38 of each of the plurality of loop segments 28 to be approximately a quarter of the 5.5 GHz signal wavelength.

Figure 5:
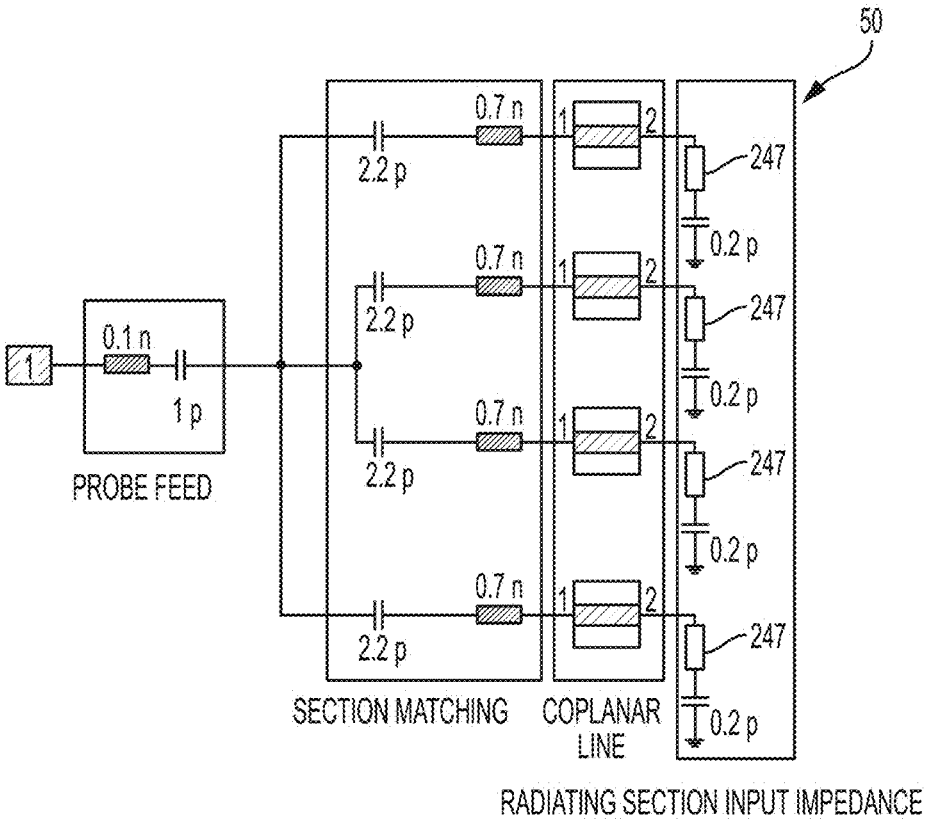
FIG. 5 is a block diagram of a 5.5 GHz equivalent circuit of the broadband Kandoian loop antenna illustrated in FIG. 4.

FIG. 5 is a block diagram of a 5.5 GHz equivalent circuit 50 of the antenna 24 illustrated in FIG. 4 and can facilitate an understanding of operation of antenna 24. However, it is to be understood that the equivalent circuit 50 only approximates the input impedance of the antenna 24 at 5.5 GHz. As seen in FIG. 5, each of four radiating sections having a load impedance of, for example, 247-j145 Ohm, can be connected to a coplanar strip transmission line composed of the copper strips of the respective transmission section 34 and the respective return section 36 and having a characteristic impedance of approximately 150 Ohm. Each of the four radiating sections can also be matched using a series inductor and capacitor or other distributed matching network. A limitation of the equivalent circuit 50 is that there is no length between the series components, and thus, no phase rotation through them. However, the voltage standing wave ratio of the equivalent circuit 50 is similar to the voltage standing wave ratio of the antenna 24 illustrated in FIG. 4.

Furthermore, the equivalent circuit 50 has greater impedance bandwidth than the antenna 24 because the respective radiating section 38 of each of the plurality of the loop segments 28 of the antenna 24 is more sophisticated than the RC load circuits of the equivalent circuit 50. For example, in some embodiments, the respective radiating section 38 of each of the plurality of loop segments 28 of the antenna 24 illustrated in FIG. 4 can include two quasi-lumped series capacitors formed by overlapping the respective radiating section 38 with the respective transmission section 34 and the respective return section 36. A quality impedance match can optimize the specific location and reactance of the quasi-lumped series capacitors.

For example, as seen in FIG. 6, a first portion 52 of the respective radiating section 38 of each of the plurality of loop segments 28 may overlap with and be capacitively coupled to a second portion 54 of the respective transmission section 34 of a respective one of the plurality of loop segments 28, and a third portion 56 of the respective radiating section 38 of each of the plurality of loop segments 28 may overlap with and be capacitively coupled to a fourth portion 58 of the respective return section 36 of the respective one of the plurality of loop segments 28. In some embodiments, each of these series capacitors formed by the overlapping first, second, third, and fourth portions 52, 54, 56, 58 can provide reactance that is inversely related to a surface area of plates forming the capacitors, that is, the amount of the copper strips overlapping, and in some embodiments, a diameter of the antenna 24 and the surface area of the overlapping portions 52, 54, 56, 58 can constitute critical impedance matching parameters.

Figure 2:
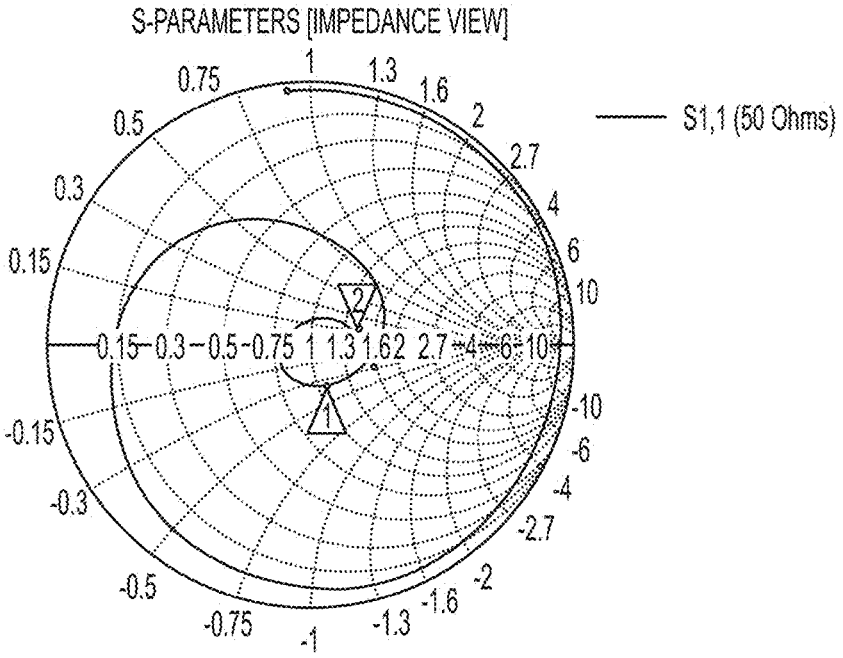
FIG. 2 is a graph illustrating input impedance versus frequency for a broadband Kandoian loop antenna in accordance with disclosed embodiments.
Figure 7:
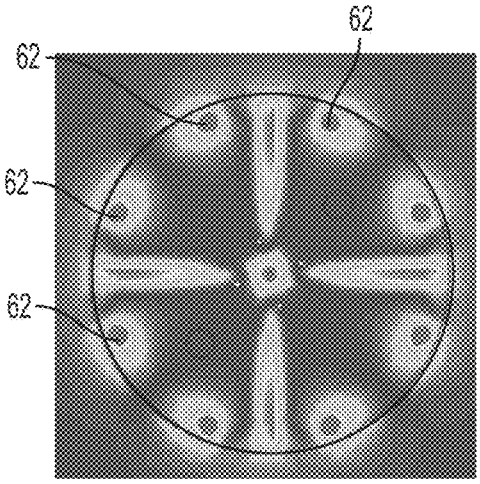
FIG. 7 is a graph illustrating electric field distribution of a broadband Kandoian loop antenna in accordance with disclosed embodiments.

The electric field distribution of the Kandoian loop antenna known in the art includes well-defined peaks at certain points on its radiating branches. Advantageously, placing the quasi-lumped series capacitors of the antenna 24 at known peaks 62 of the electric field, as seen in FIG. 7, can extend the operational bandwidth of the antenna 24 by slowing the input reactance of the respective radiating section 38 of each of the plurality of loop segments 28. In this regard, FIG. 2 is a graph illustrating input impedance versus frequency for the antenna 24. As seen in FIG. 2, the input impedance can change more slowly with frequency as compared to the Kandoian loop antenna known in the art, which is illustrated in FIG. 1. Such a slow input impedance change may allow the antenna 24 to be directly connected to a 50 Ohm transmission line with high matching efficiency over a wide frequency band.

Figure 8:
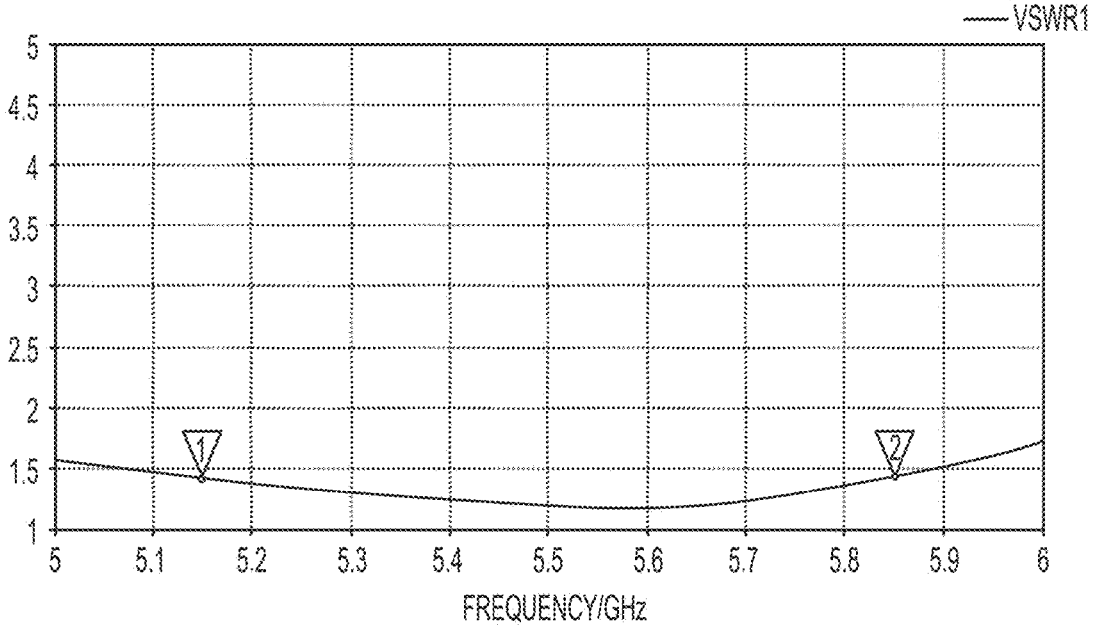
FIG. 8 is a graph illustrating a voltage standing wave ratio of a broadband Kandoian loop antenna in accordance with disclosed embodiments.

FIG. 7 is a graph illustrating the electric field distribution of the antenna 24, and FIG. 8 is a graph illustrating a voltage standing wave ratio of the antenna 24. As explained above and as seen in FIG. 7, the peaks 62 of the electric field can correspond to the location of the quasi-lumped series capacitors formed by the overlapping portions 52, 54, 56, 58 of the respective transmission section 34, the respective return section 36, and the respective radiating section 38 of each of the plurality of loop segments 28. In some embodiments, the antenna 24 operating at 5.15 GHz can have a relatively long radiation length as compared to the antenna 24 operating at 5.85 GHz, and in some embodiments, the antenna 24 operating at 5.15 GHz can yield a greater fringing electric field across elements of the plurality of loop segments 28 that yields a greater effective series capacitance compared to the computed parallel-plate value. In still further embodiments, the input impedance at 5.85 GHz can have greater capacitive reactance than at 5.15 GHz, but the increase in frequency can help slow its change, thereby increasing the bandwidth of the antenna 24. For example, in some embodiments, the input impedance to the respective transmission section 34, the respective return section 36, and the respective radiating section 38 of each of the plurality of loop segments 28 can be 194-j17 Ohm at 5.15 GHz and 158-j223 Ohm at 5.85 GHz. In some embodiments, the antenna 24 can be connected to the coaxial cable 32 and achieve a voltage standing wave ratio of 1.5:1 with a 50 Ohm reference impedance.

Figure 9:
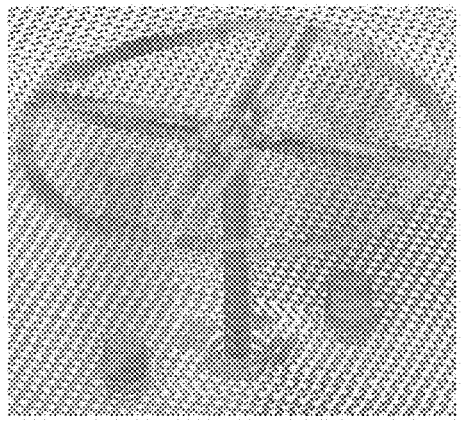
FIG. 9 is a graph illustrating current distribution of a broadband Kandoian loop antenna in accordance with disclosed embodiments.

FIG. 9 is a graph illustrating the current distribution of the loop antenna 24 in accordance with disclosed embodiments. In some embodiments, where the distance from the center of the respective radiating section 38 of each of the plurality of loop segments 28 to the respective short circuit point is half of the 5.5 GHz signal wavelength, a high current condition may be enforced at a center point of the respective radiating section 38 of each of the plurality of loop segments 28. Furthermore, in some embodiments, the diameter of the antenna 24 can be half of the 5.5 GHz signal wavelength and exhibit properties similar to two half-wavelength-spaced 180° out of phase curved dipoles. In some embodiments, the current distribution of the antenna 24 can be circular, and the circulating current can radiate a horizontally polarized electric field in the azimuth plane and can approximate the current distribution of a small circular loop antenna driven by a constant current. In some embodiments, the electric field radiated by the antenna 24 can be horizontally polarized and omnidirectional in the azimuth plane and, in general, phi polarized throughout space. In this regard, in some embodiments, the highly symmetric nature of the embodiments disclosed herein can closely approximate the exemplary radiation patterns of a theoretical circular loop antenna.

Figure 10:
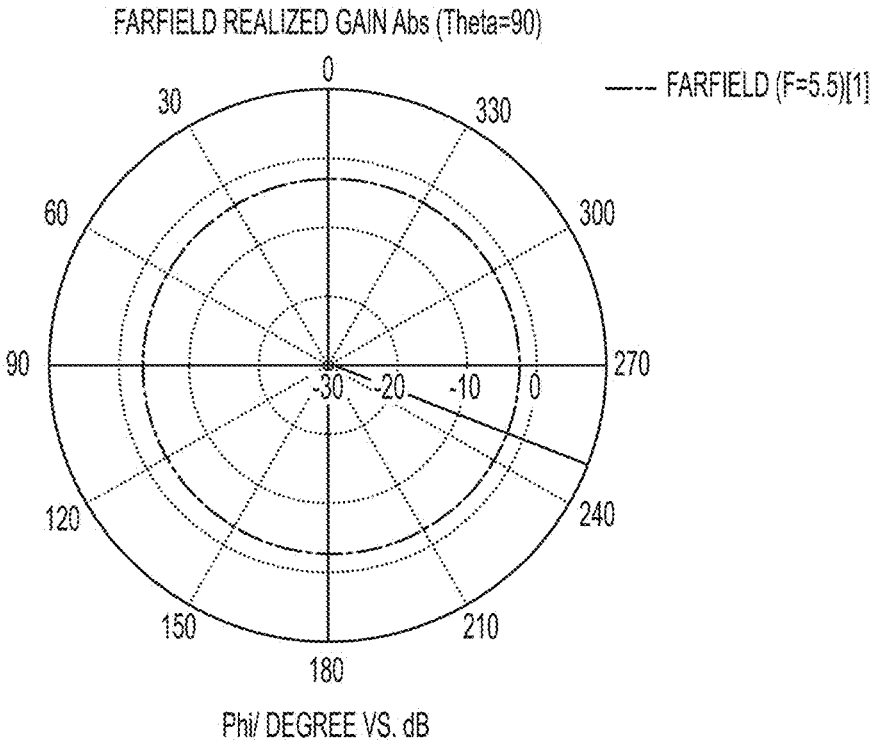
FIG. 10 is a graph illustrating a radiation pattern in the azimuth plane of a broadband Kandoian loop antenna in accordance with disclosed embodiments operating at 5.5 GHz.
Figure 11:
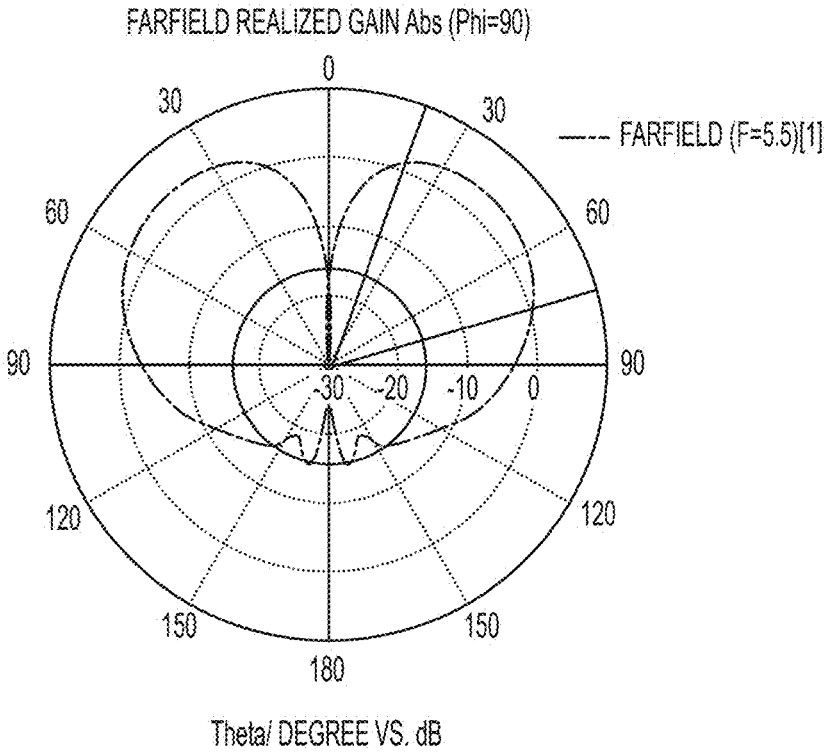
FIG. 11 is a graph illustrating a radiation pattern in the elevation plane of a broadband Kandoian loop antenna in accordance with disclosed embodiments operating at 5.5 GHz.
Figure 12:
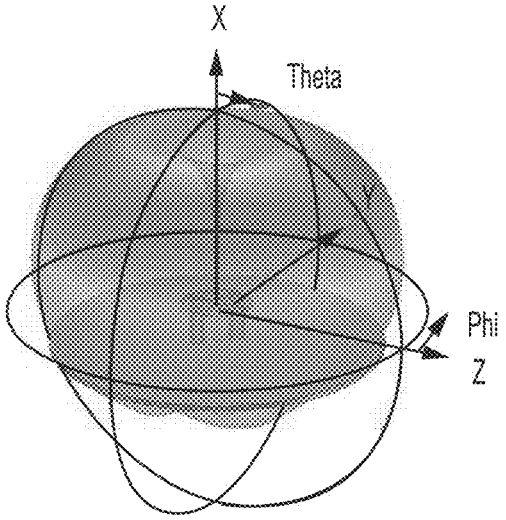
FIG. 12 is a three dimensional graph illustrating a radiation pattern of a broadband Kandoian loop antenna in accordance with disclosed embodiments operating at 5.5 GHz.

FIG. 10, FIG. 11, and FIG. 12 are different graphs illustrating the radiation pattern of the antenna 24. For example, FIG. 10 is a graph illustrating the radiation pattern in the azimuth plane of the antenna 24 operating at 5.5 GHz, FIG. 11 is a graph illustrating the radiation pattern of the antenna 24 in the elevation plane operating at 5.5 GHz, and FIG. 12 is a three-dimensional graph illustrating the radiation pattern of the antenna 24 operating at 5.5 GHz. As shown in FIG. 11 and FIG. 12, the radiation pattern may include an up-tilt in the elevation plane resulting from constructive reflections off the ground plane, and in some embodiments, such an up-tilt can be desirable, such as when the antenna 24 is deployed in a ceiling mounted Wi-Fi access point.

Figure 13:
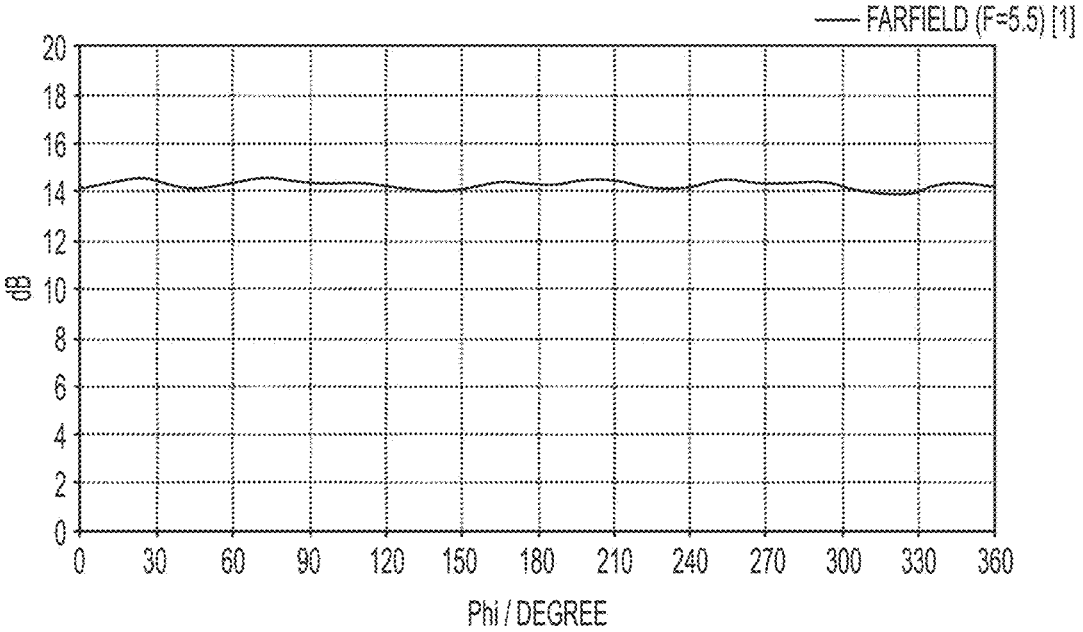
FIG. 13 is a graph illustrating a ratio of horizontally polarized radiation to vertically polarized radiation in the azimuth plane for radiation of a broadband Kandoian loop antenna in accordance with disclosed embodiments.

Finally, FIG. 13 is a graph illustrating a ratio of horizontally polarized radiation to vertically polarized radiation in the azimuth plane of the antenna 24. The illustrated flat response suggests that isolation between the antenna 24 and any other antenna is invariant under rotation of the antenna 24, which can be a valuable feature when collocating a plurality of antenna elements because such a feature reduces an optimal parameter space.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A loop antenna comprising:

a plurality of loop segments, each of the plurality of loop segments including a respective transmission section, a respective return section, and a respective radiating section, wherein the respective transmission section of each of the plurality of loop segments is electrically coupled to an input feed of a coaxial cable transmission line, wherein the respective transmission section of each of the plurality of loop segments is capacitively coupled to the respective radiating section of a respective one of the plurality of loop segments, wherein the respective radiating section of each of the plurality of loop segments is capacitively coupled to the respective return section of the respective one of the plurality of loop segments, wherein the respective return section of each of the plurality of loop segments is electrically coupled to a respective short circuit point of the respective one of the plurality of loop segments, wherein the respective short circuit point of each of the plurality of loop segments is electrically coupled to a return portion of the coaxial cable transmission line, wherein each of the plurality of loop segments is printed on a substrate of a printed circuit board, wherein the respective radiating section of each of the plurality of loop segments is printed on a first plane of the substrate, and wherein the respective transmission section and the respective return section of each of the plurality of loop segments are printed on a second plane of the substrate that is parallel to the first plane.

2. The loop antenna of claim 1 wherein a first portion of the respective radiating section of each of the plurality of loop segments overlaps with a second portion of the respective transmission section of the respective one of the plurality of loop segments, and wherein a third portion of the respective radiating section of each of the plurality of loop segments overlaps with a fourth portion of the respective return section of the respective one of the plurality of loop segments.

3. The loop antenna of claim 2 wherein the first portion of the respective radiating section of each of the plurality of loop segments overlaps with the second portion of the respective transmission section of the respective one of the plurality of loop segments and the third portion of the respective radiating section of each of the plurality of loop segments overlaps with the fourth portion of the respective return section of the respective one of the plurality of loop segments at peak points of an electric field of the loop antenna.

4. The loop antenna of claim 1 wherein each of the plurality of loop segments is evenly distributed around a center of the printed circuit board.

5. The loop antenna of claim 1 wherein a distance between the respective short circuit point of each of the plurality of loop segments and a center of the respective radiating section of the respective one of the plurality of loop segments is half of a 5.5 G Hz signal wavelength.

6. The loop antenna of claim 1 wherein a length of the respective radiating section of each of the plurality of loop segments is a quarter of a 5.5 GHz signal wavelength.

7. The loop antenna of claim 1 wherein the respective transmission section of each of the plurality of loop segments includes a respective impedance matching portion.

* * * * *